United States Patent [19]

Deering

[11] 4,069,132

[45] Jan. 17, 1978

[54] OIL SHALE RETORTING PROCESS WITH DESULFURIZATION OF FLUE GAS

[75] Inventor: Roland F. Deering, Brea, Calif.

[73] Assignee: Union Oil Company of California, Los Angeles, Calif.

[21] Appl. No.: 713,384

[22] Filed: Aug. 11, 1976

Related U.S. Application Data

[63] Continuation-in-part of Ser. No. 631,055, Nov. 12, 1975, abandoned.

[51] Int. Cl.[2] ..... C10G 1/02

[52] U.S. Cl. ..... 208/11 R; 201/16

[58] Field of Search ..... 208/11 R; 201/16

[56] References Cited

U.S. PATENT DOCUMENTS

| | | | |
|---|---|---|---|
| 1,703,192 | 2/1929 | Hampton | 208/11 R |
| 2,560,767 | 7/1951 | Huff | 208/11 R |
| 2,814,587 | 11/1957 | Van Dijck | 208/11 R |
| 3,475,319 | 10/1969 | MacLaren | 208/11 R |
| 3,516,787 | 6/1970 | Van Nordstrand | 208/11 R |

*Primary Examiner*—Delbert E. Gantz
*Assistant Examiner*—James W. Hellwege
*Attorney, Agent, or Firm*—Gregory F. Wirzbicki; Lannas S. Henderson; Richard C. Hartman

[57] ABSTRACT

A method is provided for retorting oil shale whereby full utilization of the heat energy available in the retorted shale and maximum desulfurization of the flue gas released to the atmosphere are simultaneously effected. Basically, the process comprises passing a crushed shale feed upwardly through preheating and retorting zones in a retort vessel wherein eduction of shale oil and product gases is achieved by direct heat exchange with a preheated, recycled portion of said product gases passed countercurrently to the shale feed, and then passing the retorted shale downwardly through combustion and cooling zones. Complete combustion of coke on the retorted shale in the combustion zone not only results in full utilization of the potential heat energy stored within the retorted shale but also in the production of gaseous sulfur components (mostly $SO_2$) that chemically react with the alkaline components of the shale. Concurrent flow of gas and retorted shale in the combustion zone at temperatures between 900° and 1670° F permits the reaction between said $SO_2$ and the alkaline components of the shale to proceed essentially to completion, thus desulfurizing the flue gas produced in said combustion zone.

23 Claims, 2 Drawing Figures

PEAK COMBUSTION ZONE TEMPERATURE VS $SO_2$ CONCENTRATION IN FLUE GAS

OIL SHALE RETORTING PROCESS WITH DESULFURIZATION OF FLUE GAS

CROSS REFERENCE TO RELATED APPLICATIONS

This is a continuation-in-part of copending application Ser. No. 631,055, filed Nov. 12, 1975 now abandoned.

BACKGROUND OF THE INVENTION

This invention relates generally to a process for the treatment of oil-containing or oil-producing solids to extract fuel gases and liquid crude oil products therefrom. More particularly, the invention relates to a process for the retorting of oil shale to produce a high BTU product gas in addition to liquid shale oil and, at the same time, to recover as much heat energy from the retorted oil shale as is practicable while at the same time discharging a flue gas essentially free of sulfur compounds to the atmosphere.

Vast deposits of oil shale, a sedimentary inorganic rock containing about 35 weight-percent calcite ($CaCO_3$), 15 weight-percent dolomite ($MgCO_3.CaCO_3$), and 10 weight-percent alkali metal salts are known to exist in the United States, especially in the Green River formation in Colorado, Utah, and Wyoming. The oil shale in these deposits contains between 5 and 35 weight-percent of hydrocarbons in a form known as kerogen. When pyrolized, this kerogen decomposes to produce crude shale oil vapors, which, upon condensation, become a valuable source of fuel.

Several pyrolytic processes have heretofore been developed to produce crude shale oil from oil shale. One such process is shown in my previous U.S. Pat. No. 3,361,644, which is incorporated herein by reference. In this process oil shale is fed upwardly through a vertical retort by means of a reciprocating piston. The upwardly moving oil shale continuously exchanges heat with a downwardly flowing high-specific-heat, hydrocarbonaceous recycle gas introduced into the top of the retort at about 1200° F. In the upper section of the retort (the pyrolysis zone), the hot recycle gas educes hydrogen and hydrocarbonaceous vapors from the oil shale. In the lower section (the preheating zone), the oil shale is preheated to pyrolysis temperatures by exchanging heat with the mixture of recycle gas and educed hydrocarbonaceous vapors plus hydrogen. Most of the heavier hydrocarbons condense in this lower section and are collected at the bottom of the retort as a product oil. The uncondensed gas is then passed through external condensing or demisting means to obtain more product oil. The remaining gases are then utilized as a product gas, a recycle gas as hereinbefore described, and a fuel gas to heat the recycle gas to the hereinbefore specified temperature of 1200° F.

The advantages of this process, especially in comparison to those processes wherein retorting heat is generated by combustion within the retort itself, and wherein a gas containing air is used as the combustion-eduction gas, are numerous. Firstly, the product gas is of high BTU content and is therefore suitable as a commercial fuel. Secondly, by using a high specific heat recycle gas, it is possible to educe more oil from the shale rock per volume of recycle gas utilized; thus, higher mass velocities of oil shale can be employed and no loss in yield is realized. Also, the use of a recycle gas containing essentially no oxygen avoids the oxidation and degradation of the shale oil product into gums, tars, etc. Furthermore, since the recycle gas is heated by means external to the retort, retorting temperature control difficulties (which usually result in excessive cracking of shale oil vapors in the retorting zone and the formation of clinkers which adversely affect the flow of the oil shale in the retort) are not encountered. Moreover, because of the better control of temperature in the retorting zone, the process can be so optimized that minimum heating rates, maximum oil yields, and a minimizing of the amount of coke left on the retorted shale can all be achieved. Lastly, no problem is encountered, as is common in prior art gas-upflow retorting processes, of refluxing of product oil in the preheating and eduction zones, with consequent loss of yield by polymerization into heavy residual fractions; instead, the condensed liquid product is continuously swept by gravity and gas flow away from the retorting zone.

However, one disadvantage in the foregoing process resides in the use of a portion of the product gas as fuel for heating the recycle gas, rather than using the coke on the spent shale. This represents a loss in thermal efficiency and a wasting of potential heat energy. Prior art attempts to use the coke in the retorted shale to provide heat energy for heating the recycle gas usually result in other disadvantages. For example, in U.S. Pat. No. 3,503,869 to Haddad, the use of the coke in retorted shale as a source of fuel necessarily results in a dilution of the product gas with gaseous products of combustion; this produces a product gas of lower BTU content than that produced in processes having effective means for separating the recycle gas and the flue gas. Thus, a method is required which will utilize the potential heat energy of the coke on the retorted shale without also sacrificing the advantages obtained in my previously described process.

In addition to the difficulties posed by the foregoing, the development of a practical shale oil recovery method is also hampered by the fact that the operation of present commercial processes results in the atmospheric discharge of flue gases containing excessive proportions of sulfur compounds sometimes in excess of 3000 ppmv total sulfur compounds. In the U.S.S.R., for example, one of the major impediments to the development of a successful shale oil recovery process is the difficulty in preventing the atmospheric discharge of sulfur compounds. (See Oil & Gas Journal, Vol. 73, No. 40, Oct. 6, 1975, pages 42–43).

A review of present oil shale retorting techniques will reveal that the discharge of sulfur compounds therefrom is especially difficult to prevent. In processes wherein a portion of the product gas is utilized as a fuel to provide heat for retorting purposes, the $H_2S$ normally present in said fuel is also burned and is hence discharged to the atmosphere as $SO_2$. In those processes wherein the coke on the retorted shale is burned to provide direct heat for retorting, the operating conditions are usually such that only partial combustion of the coke is effected, this being necessary to prevent temperatures in the combustion zone from becoming excessive and thus causing clinkering and unnecessary cracking of the shale oil vapors. In so doing, however, $H_2S$, a contaminant which some air pollution regulations require to be discharged in concentrations no greater than about 10 ppmv, is released from the coke in substantial amounts and must be removed from the flue gases by means of costly sulfur recovery processes. On the other hand, in those processes in which the coke is fully combusted, the resulting flue gases may contain excessive amounts of $SO_2$, another pollutant whose atmospheric discharge must be controlled. In Colorado, for example, $SO_2$ is required to be discharged in concentrations no greater than 150 ppmv, or no greater than 500 ppmv if the total amount of $SO_2$ discharged in one day is no greater than 5 tons.

It is therefore one object of the present invention to provide an oil shale retorting process which significantly reduces atmospheric pollution caused by discharge of gaseous sulfur compounds. It is another object to provide a process combining the advantages of my process described in U.S. Pat. No. 3,361,644 with that of utilizing to the fullest extent possible the potential heat energy available in the coke in the retorted shale. It is yet another object to provide an oil shale retorting process whose overall efficiency is maximized by converting most of the kerogen in the oil shale to useful products of shale oil and undiluted, high BTU fuel gas, while the remainder is utilized to the fullest extent possible as a source of heat energy. It is another object to provide a method for continuously combusting essentially all the coke on the retorted shale traversing the combustion zone of an oil shale retorting process and, at the same time, continously removing from said combustion zone a flue gas that is essentially free of sulfur compounds. Other objects will appear to those skilled in the art from the specification and claims herein.

SUMMARY OF THE INVENTION

The present invention provides a novel oil shale retorting process which utilizes essentially all the potential heat energy available in the retorted shale, produces a flue gas containing no more than about 100 ppmv of total sulfur compounds, and produces a high BTU product gas and an essentially unoxidized product shale oil.

One embodiment of the process of the invention involves firstly passing a crushed shale feed upwardly in a vertical retort wherein, by direct heat exchange with a countercurrently fed eduction gas, shale oil vapors and product gases are educed in a pyrolysis zone and the separated by the condensation of said shale oil vapors in a subjacent preheating zone, from which product gases and liquid shale oil product are collected. The eduction gas consists of a preheated portion of the product gas, and, since it therefore is of the same chemical makeup as the uncondensed product vapors, the final product gases are not diluted with $N_2$, $O_2$, or excessive quantities of CO and $CO_2$; they thus retain their high BTU content. Also, because the eduction gas contains essentially no oxygen, the liquid shale oil product is collected unoxidized and essentially free of undesirable polymers, gums, and sludge.

After being retorted, the shale is passed into a combustor wherein it gravitates successively through a combustion zone and a cooling zone. Eduction gases employed in the retort and gases present in the combustor are maintained separately from each other by means of a steam seal between the retort and the combustor, the upper portions of both of which are preferably maintained at an equal gas pressure. Separating the retort and combustor gases in this manner not only prevents the dilution of eduction gases with air and flue gases from the combustor or the loss of said eduction gases by passage into the combustor, but also makes it possible to utilize high temperatures in the combustion zone without also causing excessive cracking of shale oil vapors in the retort. An air/flue gas mixture utilized to support combustion in the combustion zone of the combustor is introduced at the top of the combustion zone, is then passed concurrently with the descendingly moving shale, and finally is removed as a flue gas at the bottom of said combustion zone. All coke available for combustion in the retorted shale is burned in the combustion zone, at a temperature between about 900° and 167° F., and essentially all of the gaseous sulfur components released in said combustion zone are in one or more forms, or converted to one or more forms, that react with the alkaline components of the shale traversing the combustion zone to produce stable inorganic salts.

DETAILED DESCRIPTION OF THE INVENTION

Any of a large number of naturally occurring oil-producing solids can be used in this process. The characteristics of these materials are generally well known and hence need not be described in detail. For practical purposes however, the the raw shale should contain at least about 10, preferably at least 20, and usually between about 20 and about 80 gallons of oil per ton of raw shale by Fischer assay. The shale should be crushed to produce a raw shale feed having no particles greater than 6 inches and preferably none greater than 3 inches mean diameter. Average particle sizes of ⅛-inch to about 3 inches mean diameter are preferred.

Figure 1:
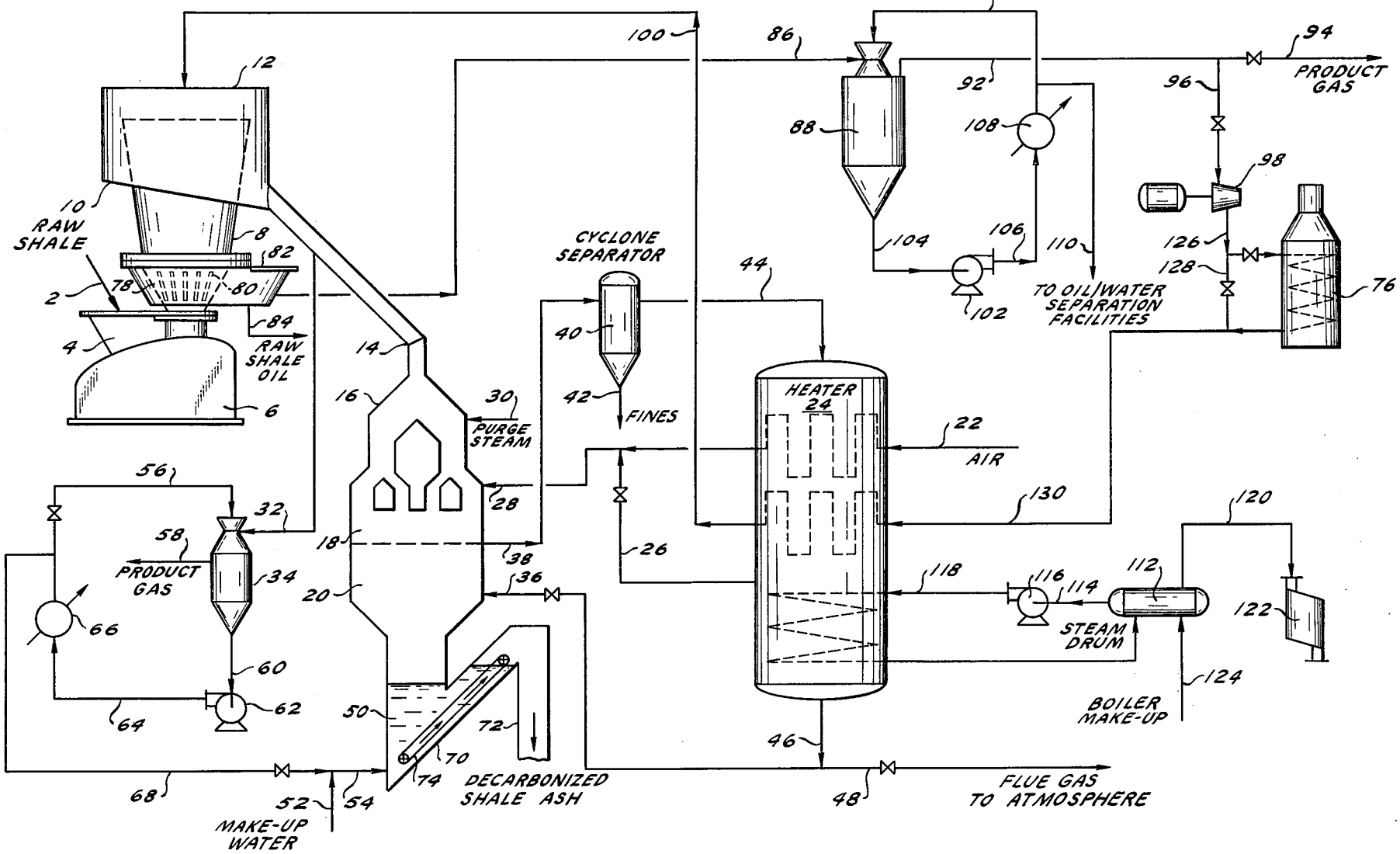
FIG. 1 is a schematic illustration of the preferred embodiment of this invention and also includes the major items of equipment employed, some of which are represented in partial cross-sectional views.

The process may best be understood by reference to FIG. 1 of the drawing. It will be understood, however, that for the sake of simplicity conventional pumps, compressors, level-control devices, and other equipment which form no part of the invention nor aid in its description have, for the most part, been omitted.

Referring now to FIG. 1 of the drawing, raw crushed oil shale is fed at 2 into hopper 4 of shale feeder 6 from which it is pumped upwardly into retort 8. The details of shale feeder 6 are described in more detail in my U.S. Pat. No. 3,361,644. The shale feed rate will, of course, vary considerably depending upon the size of the retort and the desired holding time therein.

The raw shale passes upwardly through retort 8, traversing a lower preheating zone and an upper retorting (or pyrolysis) zone. Temperatures in the lower portion of the retort are sufficiently low to condense product oil vapors from the superjacent retorting zone. As the shale progresses upwardly through the retort its temperature is gradually increased to retorting levels by countercurrently flowing eduction gases comprising a preheated recycle portion of retort product gas from line 100. This product gas, and hence also the recycle gas, are of high BTU content, generally between about 700 and 1000 BTU/$Ft^3$, and also of high specific high, usually between about 14 and 18 BTU/mole/°F. Eduction temperatures are conventional, usually in excess of about 600° F, and preferably between about 900° and about 1200° F. Essentially all of the oil will have been educed from the shale by the time it reaches a temperature of about 900° F. Gas temperatures above about 1300° F in the eduction zone should not be exceeded since they result in excessive shale oil cracking. Other retorting conditions include shale residence times in excess of about 10 minutes, usually about 30 minutes to about one hour, sufficient to educe the desired amount of oil at the selected retort temperatures. Shale feed rates usually exceed about 100, and are preferably between about 400 and about 2000 pounds per hour per square foot of cross-sectional area in the retort. These values refer to average cross-sectional areas in the tapered retort illustrated in the drawing.

Pressure in retort 8 may be either subatmospheric, atmospheric, or superatmospheric. Retorting pressures normally exceed about 0.3 and are preferably between about 5 and about 1000 psia. The recycle gas is introduced via line 100 at a temperature and flow rate sufficient to heat the crushed shale to retorting temperatures. Heat transfer rates depend in large part on the flow rate, temperature, and heat capacity of this recycle gas. Flow rates of at least about 3000, generally at least about 8000, and preferably between about 10,000 and about 20,000 SCF of recycle gas per ton of raw shale feed are employed. The temperature differential between the recycle gas and solids at the top of the retorting zone is usually between 10° and 100° F. Excessive temperature differentials, e.g., in excess of about 400° F should be avoided.

As the recycle gas from line 100 passes downwardly through retort 8, it continuously exchanges heat with the upwardly moving oil shale. In the upper portion of retort 8 oil contained within the oil shale is educed therefrom by pyrolysis, thereby producing shale oil vapors and fuel gases comprising such normally uncondensable gases as methane, hydrogen, ethane, etc. These shale oil vapors and fuel gases pass downwardly with the recycle gas, firstly into the lower portion of retort 8 wherein the cool oil shale condenses the shale oil vapors, and thence into a frusto-conical product disengagement zone 78. This disengagement zone comprises peripheral slots 80 through which liquid shale oil and product vapors flow into surrounding product collection tank 82. The liquid shale oil is withdrawn therefrom at a rate between about 5 and 60 gallons/ton of raw shale feed via line 84, while the aforementioned product vapors at a temperature between about 80° and 300° F are withdrawn via line 86.

The product vapors are introduced into venturi scrubber 88 wherein a liquid scrubbing medium recirculating via line 90 is used to remove any remaining traces of water, shale oil vapors, and shale oil mist contained therein. The shale oil/water mixture so obtained in venturi scrubber 88 is directed by pump 102 via lines 104 and 106 to condenser 108 in which the shale oil/water mixture is cooled by indirect heat exchange with cold water to provide as much recirculating scrubbing medium via line 90 as necessary, the remainder being sent to appropriate shale oil/water separation facilities via line 110. An essentially mist-free product gas having both high BTU and high specific heat properties is obtained at a rate between about 11,000 and 21,000 SCF/ton of raw shale feed from venturi scrubber 88 via line 92. A portion of this product gas is then sent to storage via line 94 while the remainder is recycled to retort 8 via line 96, compressor 98, lines 126, 128, and 139, preheater 24, and line 100.

While the product vapors are being removed from retort 8 via line 86 and collected as a product gas via line 94, the retorted oil shale overflowing the top of retort 8 falls onto the inclined peripheral floor 10 of shroud 12, which is affixed in fluid-tight fashion to the outer wall of the retort. The retort shale, now at a temperature between about 900° and 1300° F, preferably between about 900° and 1100° F, then gravitates down floor 10 through chute 14 into the top of vertical combustor 16, in which is maintained a combustion zone 18 and upper and lower ash-cooling zones 20 and 50. The retorted shale is essentially oil-free and, when the preferred operating conditions herein are utilized, will contain at least about 2%, usually between 3% and about 5%, and preferably at least 3% by weight of carbon as coke. (As used herein, the term coke refers to all the carbon-containing components remaining in the oil shale after retorting.) Usually, this coke contains at least about 0.5 wt.%, usually between about 0.5 and 2.0 wt.% of sulfur.

None of the recycle gas used to educe shale oil and product gas from the oil shale in retort 8 is allowed to pass with the retorted shale into combustor 16. Chute 14 is provided with a purge sealing gas, preferably saturated steam, from line 30 to keep the recycle gas in retort 8 separate from the air and flue gases used in combustor 16. This purge steam is introduced at a pressure preferably about 0.01 to 15 psi greater than that maintained in the upper sections of retort 8 and combustor 16, both of which upper sections are preferably maintained at some equal pressure between about 5 and 1000 psia. Thus, some of the steam so introduced travels up chute 14 countercurrently with the descending retorted shale and is withdrawn by suction via line 32 into the throat of the venturi in venturi scrubber 34. Typical steam rates of steam fed via line 30 are between about 10 and 50 pounds per ton of raw shale feed; between about 40 and 60% of the steam so fed is recovered via line 32 while 40 to 60% commingles with the gases in the combustor.

Air for the combustion of coke in combustor 16 is provided from line 22. It is preheated in heater 24 to between about 100° and about 800° F and then diluted with a flue gas at between about 200° and 800° F from line 26. The resultant mixture is fed through line 28 into the top of the combustion zone 18 at a temperature between about 100° and 800° F. The amount of the flue gas-air mixture which is introduced to the combustor 16 via line 28 is between about 12,000 and about 34,000 SCF/per ton of raw shale feed, of which about 40% to about 90% comprises air from line 22.

The dilution of the air from line 22 with flue gas from line 26 as hereinbefore set forth is critical if external temperature control in combustor 16 is to be avoided. The peak temperature in the combustion zone should be maintained above about 900° F, usually between about 1200° and 1670° F, preferably between 1400° and 1650° F, and more preferably still between 1400° and 1600° F. Without dilution of the air with the flue gas from line 26 (or some other source of inert gas) peak temperatures in the combustion zone 18 of combustor 16 can easily exceed 1670° F, thereby resulting in the discharge via line 38 of a flue gas containing excessive proportions of $SO_2$.

Preferably, the air-flue gas feed rate and the feed rate of the retorted shale in the combustion zone are adjusted so that (a) unconsumed oxygen will be present in the flue gas leaving the combustion zone via line 38 and (b) essentially all the coke contained within the retorted shale while is available for combustion is consumed. Generally speaking, at least 80 wt.%, more usually at least 90 wt.%, of the coke in the retorted shale can be consumed under the preferred operating conditions herein, the remaining 10 to 20 wt.% being so deeply embedded within the sedimentary rock itself that it is essentially incombustible. Normally, the design of the combustor should be such that shale feed rates in the combustion zone 18 will be between about 300 and 800 pounds per hour per square foot of average cross-sectional area while residence times in the combustion zone 18 will vary between 0.25 and 2 hours. Such feed rates and residence times will insure that maximum combustion of coke contained in the retorted shale is effected.

The desulfurization of the flue gases produced in combustion zone 18 is believed to be accomplished herein by the chemical reaction of gaseous sulfur components produced in the combustion zone 18, such as $SO_2$, $SO_3$, etc., with the alkaline components of the retorted or decarbonized shale rock to produce stable inorganic salts. (The terms alkakline components and alkaline mineral components, as used herein, refer to those components of the retorted or decarbonized shale which react, or decompose under combustion zone conditions to components which react, with one or more gaseous sulfur components at elevated temperatures to produce a stable inorganic salt.) Although the invention is not intended to be limited to any particular theory, it is presumed that the $CaCO_3$ and, to a lesser extent, the $MgCO_3$ components of the retorted shale rock passing through the combustion zone decompose to CaO and MgO, respectively, and that these components react mainly with $SO_2$ or $SO_2$ and $O_2$ to form one or more of the salts: $CaSO_3$, $CaSO_4$, $MgSO_3$, and $MgSO_4$. When shale from the Green River formation is being processed by the method herein described, essentially complete removal of the $SO_2$ is easily achieved because of the relatively large amount of calcite and dolomite available in such shale. With such shales, complete desulfurization of the flue gases (i.e., to less than 100 ppmv of total sulfur compounds) is easily achieved. For other shales complete desulfurization of the flue gases will be achievable only if the ratio between the weight percent of calcite plus dolomite in the retorted shale to the weight percent of total sulfur in the retorted shale is at least 2:1, preferably at least 5:1. In the absence of other alkaline components in the raw shale which can chemically react with the $SO_2$, or unless a substantial percentage of said total sulfur is present as a stable inorganic component, ratios of calcite plus dolomite to total sulfur less than a 2:1 ratio will produce only partial desulfurization.

Desulfurization of the combustion zone flue gas by the process of the invention results in the discharge from said combustion zone of no more than about 5.0 SCF of total gaseous sulfur compounds per ton of raw shale feed. When the preferred combustion zone operating conditions hereinbefore recited are utilized, the flue gas leaving the combustion zone (i.e., before being combined with the gases utilized in the cooling zone in the manner to be shown hereinafter) will contain less than 100 ppmv of total gaseous sulfur compounds; this corresponds, on the average, to less than about 2.5 SCF of gaseous sulfur compounds discharged from the combustion zone per tone of raw shale feed. When conditions are chosen which tend to maximize the residence time of the retorted shale in the combustion zone maintained at a temperature less than 1600° F, the flue gas discharged from said combustion zone will contain less than 50 ppmv of total sulfur compounds; this corresponds, on the average, to less than about 1.25 SCF of total sulfur compounds discharged per ton of raw shale feed. It should be noted, however, that for the range of combustion zone conditions given herein, the flue gas limitations of 100 ppmv and 50 ppmv of total gaseous sulfur compounds discharged correspond, respectively, to the discharge of between about 1.5 and 3.5 and about 0.75 and 1.75 SCF of said sulfur compounds per ton of raw shale feed.

Under ideal conditions it is possible to produce a flue gas containing less than 10 ppmv of total sulfur compounds, which corresponds, on the average, to less than about 0.25 SCF of sulfur compounds discharged per tone of raw shale feed. As shown in the Example hereinafter, it is possible to produce a flue gas containing less than 10 ppmv of $SO_2$. However, trace amounts of other sulfur compounds may also be present in the flue gas. COS may be present in proportions as high as 30 ppmv while mercaptans may be as high as 5 ppmv. The total concentration of other sulfur compounds, however, will be less than 5 ppmv. Hence, in accordance with this invention, the $H_2S$ concentration will be less than 5 ppmv in the flue gas, usually less than 1 ppmv.

It is an essential feature of the preferred embodiment of the invention that both the maximum desulfurization of the flue gas produced in the combustion zone 18, and the full releasing of the heat energy stored in the retorted shale be simultaneously effected. Incomplete combustion (i.e., with insufficient oxygen) of the coke usually results in the liberation of $H_2S$ in the combustion zone 18, which $H_2S$ being essentially unreactable with the alkaline shale ultimately must be discharged as an atmospheric pollutant with the flue gas. But complete combustion of the coke insures that essentially all gaseous sulfur compounds which were not relesed from the shale as $SO_2$ will be converted to $SO_2$, which $SO_2$ is chemically reactable with the alkaline components of the shale under the conditions hereinbefore specified. Hence by fully releasing the heat energy stored within the retorted shale, it is insured that a completely desulfurized flue gas will be produced.

(It should be noted that it is possible in non-preferred embodiments of the invention to discharge a completely desulfurized flue gas and not burn all the available coke on the retorted shale. For example, if the residence time for the retorted shale passing through the combustion zone is insufficient to allow for the full combustion of the available coke, the flue gas discharged from the combustion zone may still be completely desulfurized provided it contains at least some oxygen and provided the air/flue gas feed rate is such that the gaseous sulfur components have sufficient time to react with the alkaline components traversing the combustion zone.)

Downflowing spent shale from combustion zone 18 gravitates at a rate between about 300 and 800 lbs/hr/ft$^2$ of average crosssectional area through upper cooling zone 20, suitable shale residence times therein being between about 0.25 and 2 hours. The shale descending in this cooling zone is contacted with upwardly flowing flue gas introduced from line 36 at a temperature between about 200° and 500° F and at a rate of 8,000 to 16,000 SCF/ton of raw shale feed. As this flue gas ascends to the interface of the upper cooling zone 20 and combustion zone 18, it exchanges heat with the descending shale ash by countercurrent heat exchange. Upon reaching the interface, it is combined with the hot flue gas produced in the combustion zone 18 and the resulting mixture is removed via line 38 to a cyclone separator 40 wherein fines are removed via line 42.

To recover the heat from the combined flue gases treated in cyclone separator 40, these gases, usually at a temperature between about 1400° and 1650° F when preferred operating conditions are utilized, are passed via line 44 to heater 24 wherein heat is recovered by indirect heat exchange for such purposes as preheating the air used in combustor 16, preheating the recycle gas used to educe oil from the oil shale in retort 8, and heating boiler water for the production of high pressure steam. A portion of the combined flue gases used in heater 24 is removed at a temperature between about 200° and 800° F via line 26 for the hereinbefore described purpose of diluting air to combustor 16. The remaining combined flue gases, after having had as much heat as practicable extracted therefrom, are divided into two portions, one to be sent to atmospheric discharge through lines 46 and 48 at a rate of about 15,000 to 35,000 SCF/ton of raw shale feed, and the other to be used via lines 46 and 36 as the gaseous cooling medium required in the upper cooling section 20 of combustor 16 as hereinbefore described.

Optionally and preferably, coolant to lower cooling zone 50 is provided by a water seal, especially if the operating pressure of combustor 16 is less than about 25 psig. As shown in the drawing, a water level is maintained in lower cooling zone 50 and in inclined conduit 70. The shale ash entering lower cooling zone 50 must drop to the bottom of said zone before a drag chain conveyor 74 forces the shale to discharge via line 72. Thus, final cooling of the decarbonized shale ash is accomplished by direct heat exchange with water delivered from a makeup source via lines 52 and 54 and/or with water recovered via line 68 from the purge steam employed as a sealing gas in chute 14.

It is emphasized, however, that the water seal method for cooling in the lower cooling zone 50 is not critical. In the semi-arid regions wherein oil shale is found, it may not be economical to use water in this manner. Also, the pressures employed in combustor 16 may make the length of inclined conduit 70 prohibitively long. Hence, in these and other situations wherein it is not desired to use water for cooling decarbonized shale ash, the lower cooling zone 50 can be eliminated entirely. Under such circumstances, however, mechanical means should be employed substantially to prevent the 200°-500° F flue gas introduced into the combustor 16 via line 36 from escaping with the decarbonized shale ash via conduits 70 and 71. Conventional star feeders or lock systems comprising at least two valves separated by a large compartment can be used for this purpose.

One method by which water is recovered from the purge steam in chute 14 for use in lower cooling zone 50 is by introducing the steam via line 32 into the throat of the venturi of venturi scrubber 34, said steam thus being absorbed and condensed by the cool water fed into the venturi through line 56. Upon condensation of the steam in this manner, the non-condensable gases entrained with the purge steam (i.e., fuel gases and $Co_2$ formed in chute 14 by the reaction of steam with coke in the retorted shale) are recovered as a product gas of moderately high BTU and specific heat content (200-600 BTU/Ft$^3$ and 9-13 BTU/mole°F, respectively), which product gas is recovered via line 58, normal recovery rates being between about 100 and 300 SCF/ton of raw shale feed. The heated water, however, which is produced by the mixture of purge steam and cool water, is passed via line 60 to a suitable pump 62 from which it is sent by line 64 to condenser 66 wherein it is cooled by direct or indirect heat exchange with an external source of cold water. The cool water so produced is then utilized as the source of scrubbing medium for the venturi scrubber via line 56, and as a source of coolant for lower cooling zone 50 of combustor 16 through lines 68 and 54.

As noted above, a portion of the heat of the combined flue gases entering heater 24 can be utilized to heat boiler water to generate high pressure steam. This can be accomplished by directing boiler make-up water into steam drum 112 from line 124. The water in steam drum 112 is then drawn through line 114 by means of pump 116 to be sent by line 118 into heater 24. After exchanging heat with the flue gases in heater 24, some of the water in line 118 is vaporized to pressurized steam, which, after being coolected in steam drum 112, is then passed via line 120 to a steam turbine 122, or other prime mover, for the generation of electrical power.

A fossil fuel fired heater 76 is provided for start-up purposes. This heater is used to heat the recirculating recycle gas until retort 8, combustor 16, and heater 24 come up to operating temperatures at which time it is no longer utilized.

It will be seen by those skilled in the art that the retorting process as above described integrates many of the advantages sought by the prior art but few, if any, of the disadvantages. For example, the use of concurrent flow of gas and shale in the combustion zone 18 provides, as is shown in U.S. Pat. No. 3,503,869 to Haddad, a method for effecting better control of temperature therein and for minimizing the pressure drop problems prevalent in most countercurrent processes due to the accumulation of fines. But unlike the process shown in the aforesaid patent, in the preferred embodiment of this invention essentially all the available coke within the retorted shale is necessarily conbusted so that as much heat energy as possible to recovered from the shale, and, simultaneously, the discharge of a flue gas essentially free of sulfur compounds is accomplished.

It will also be seen that the over-all thermal efficiency of the process as described hereinbefore is maximized. Essentially all the kerogen in the oil shale is utilized. A portion of the kerogen is educed from the oil shale to produce an unoxidized liquid shale oil product, an undiluted high BTU product gas, and a moderately high BTU product gas; the remainder is used to provide heat for the process and/or for conversion into useful work.

Further advantages which the art has been attempting to integrate into one process are also apparent. The eduction gas, being a recycled product gas, contains essentially no free oxygen with which educed oil can combine chemically, nor does it contain nitrogen or any more CO and $CO_2$ than that which unavoidably is educed from the oil shale with the shale oil vapors; normally, the product gases produced by the process described hereinbefore will contain no more than 8% CO and 15% $CO_2$ (by volume). Thus, this recycle gas is both of high specific heat capacity and of high BTU content, the former permitting increased shale feed rates, and the latter insuring that the product gases are of high BTU content. Additionally, none of the product gas is used as a fuel gas in the combustion zone, all the necessary fuel therein being supplied by the coke in the retorted shale. Refluxing of shale oil vapors in retort 8 is prevented by passing the eduction gas downwardly through retort 8, and, although high temperatures are utilized in the combustion zone 18, the excessive cracking of shale oil vapors usually concomitantly occurring therewith in the retort is prevented herein by effectively separating the gases produced or utilized in the combustor 16 from those produced or utilized in retort 8. Furthermore, water requirements for the process are not extreme, inasmuch as the major use of water in lower cooling zone 50 is optional. Lastly, due to the complete combustion of coke in combustor 16 enough heat is generated not only for retorting purposes but also for generating electrical power or for operating turbine drive units on pumps and compressors.

The following Example is provided to show how the $SO_2$ concentration in a combustion zone flue gas can be controlled by controlling the temperature in said combustion zone below 1670° F.

EXAMPLE

Hot retorted shale, air, and a recycle flue gas were passed concurrently through a combustion zone of a combustor. The retorted shale was fed to said combustion zone at the rate of 0.82 ton/ton of raw shale fed to a conventional retort from which said retorted shale was obtained at a temperature of about 925° F. The air feed rate was maintained at 14,000 SCF/ton of raw shale feed. The recycle flue gas feed rate was varied between about 4,000 and 15,000 SCF/ton of raw shale feed so as to control the peak combustion zone temperature at any desired temperature between about 1500° and 1750° F. Both the air and recycle flue gas were fed at 300° F. The retorted shale residence time in the combustion zone was maintained at about 1 hour. Essentially all the coke in said retorted shale was consumed.

Figure 2:
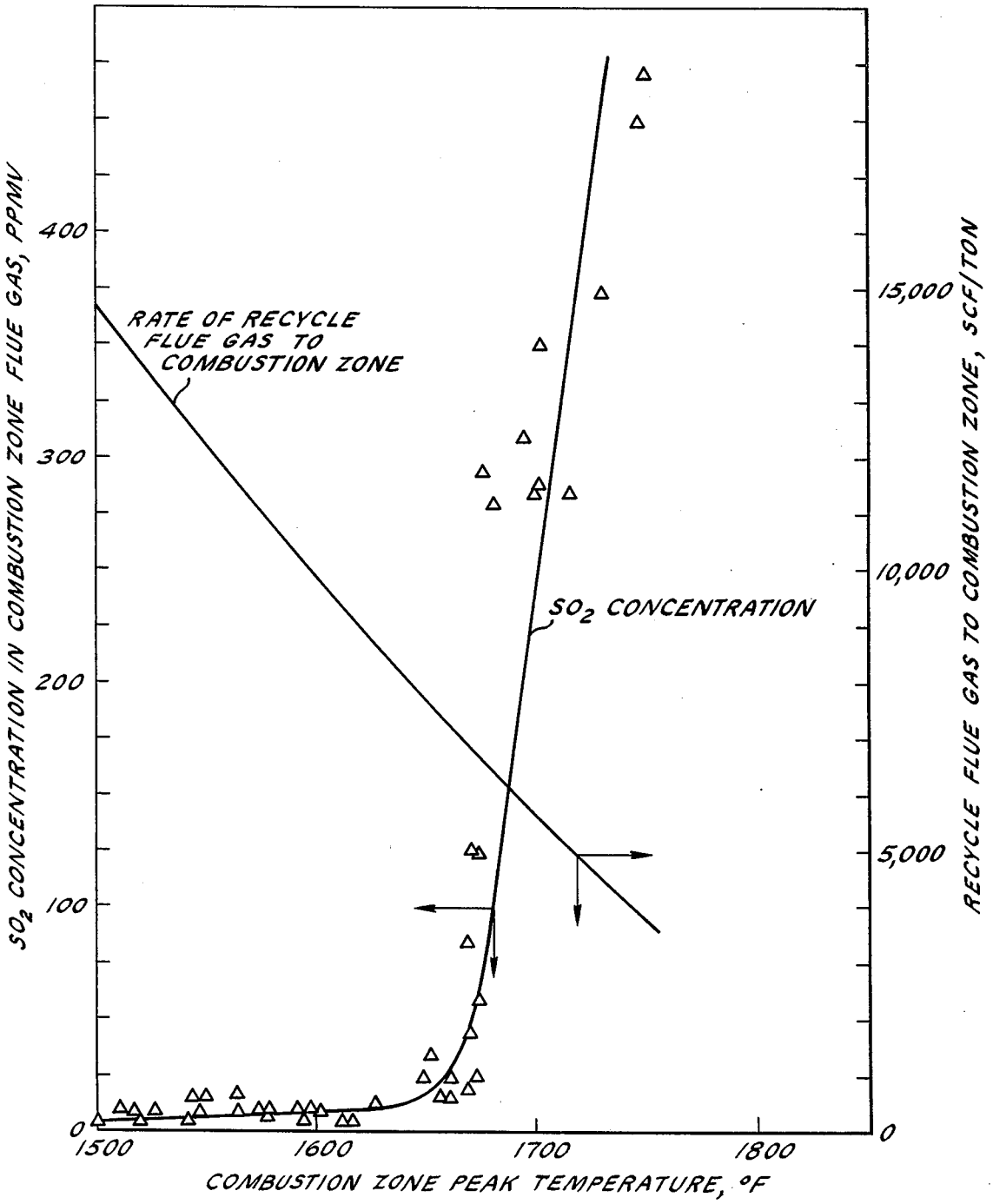
FIG. 2 is a graph showing how the concentration of $SO_2$ in the flue gas varies as a function of peak combustion zone operating temperature, as detailed hereinafter in the Example.

As shown in FIG. 2, as long as the peak combustion zone temperature was maintained below about 1640° F, the $SO_2$ concentrations (as measured by Drager tube and mass spectrometrical techniques) in the combustion zone flue gas was less than 25 ppmv, usually at or less than 10 ppmv. These figures correspond to a maximum of 0.75 and 0.3 SCF of sulfur compounds discharged from said combustion zone per tone of raw shale feed. Until the peak combustion zone operating temperature reached 1670° and 1680° F, respectively, the $SO_2$ concentration in the combustion zone flue gas was maintained below 50 ppmv and 100 ppmv. These figures correspond to a maximum of 1.5 and 3.0 SCF of sulfur compounds discharged from said combustion zone per ton of raw shale feed (assuming the maximum flue gas rate from said combustion zone is 30,000 SCF/tone of raw shale feed).

$H_2S$ concentration in the flue gas was always less than 1 ppmv, regardless of the peak temperature maintained in the combustin zone.

Although the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations that fall within the spirit and scope of the appended claims.

I claim:

1. In a continuous process for combusting coke on retorted oil shale wherein a stream of hot retorted oil shale containing alkaline mineral components, coke, and sulfur components is passed to a combustion zone to combust said coke, the combination of improvements comprising:

1. passing said stream of hot retorted oil shale through said combustion zone concurrently with a stream of gas comprising oxygen, said combustion zone being maintained at a temperature between about 900° and 1670° F and said gas being supplied in sufficient quantity and under conditions correlated with the feed rate of said shale and the temperature maintained in said combustion zone so as to:
   a. continuously combust at least some of said coke in said hot retorted oil shale passing through said combustion zone; and
   b. continuously react essentially all gaseous sulfur components produced during the combustion of step (1) (a) with sufficient of said alkaline mineral components to form stable inorganic salts; and
2. discharging from said combustion zone an oxygen-containing flue gas essentially free of sulfur compounds.

2. A process as defined in claim 1 wherein the concentration of total gaseous sulfur compounds in said flue gas is less than 100 ppm by volume.

3. A process as defined in claim 1 wherein no more than 5.0 SCF of total gaseous sulfur compounds per ton of the raw shale fed into a retort from which said retorted oil shale was obtained is discharged from said combustion zone in step (2).

4. A process as defined in claim 3 wherein the concentration of total gaseous sulfur compounds in said flue gas is less than 100 ppm by volume.

5. A process as defined in claim 4 wherein the concentration of hydrogen sulfide in said flue gas is less than 5 ppm by volume.

6. A process as defined in claim 4 wherein the temperature in said combustion zone is maintained between about 1400° and 1600° F.

7. In a continuous process for retorting oil shale wherein a stream of raw, crushed oil shale is countercurrently contacted in a retorting zone with a stream of a hot, essentially oxygen-free education gas, thereby educing from said oil shale a gaseous mixture from which a liquid shale oil product and a product fuel gas are subsequently separated, and producing from said retorting zone a hot, retorted shale containing alkaline mineral components, coke, and sulfur components, the combination of improvements comprising:

1. introducing at least a portion of about retorted shale into combustor means wherein said retorted shale is passed in succession through a combustion zone and a cooling zone, said combustion zone being maintained at a temperature between about 900° and 1670° F;
2. passing an oxidation gas comprising oxygen concurrently with said retorted shale passing through said combustion zone, said gas being supplied in sufficient quantity and under conditions correlated with the feed rate of said retorted shale and the temperature maintained in said combustion zone so as to:
   a. continuously combust essentially all of said coke in said retorted shale passing through said combustion zone; and
   b. continuously react essentially all gaseous sulfur components produced during the combustion of step (2) (a) with sufficient of said alkaline mineral components to form stable inorganic salts;

3. maintaining said eduction gas and all gases within said combustion zone separately from each other;
4. discharging from said combustion zone an oxygen containing flue gas essentially free of sulfur compounds; and
5. passing a cooling gas countercurrently with the decarbonized shale passing through said cooling zone, thereby cooling said decarbonized shale and heating said cooling gas.

8. A process as defined in claim 7 wherein no more than 5.0 SCF of total gaseous sulfur compounds per ton of said raw shale feed is discharged from said combustion zone in step (4).

9. A process as defined in claim 8 wherein said hot, retorted shale contains a weight ratio of dolomite-plus-calcite to total sulfur of at least about 5:1.

10. A process as defined in claim 8 wherein the concentration of total gaseous sulfur compounds in said flue gas is less than 100 ppm by volume.

11. A process as defined in claim 10 wherein said hot eduction gas consists of a recycled portion of said product fuel gas, said product fuel gas being essentially free of $N_2$ and $O_2$.

12. A process as defined in claim 11 wherein said flue gas of step (4) is utilized indirectly to preheat said hot eduction gas to temperatures suitable for educing said gaseous mixture from said oil shale.

13. A process as defined in claim 11 wherein the concentration of total gaseous sulfur compounds in said flue gas is less than 50 ppm by volume.

14. A process as defined in claim 11 wherein the concentration of total gaseous sulfur compounds in said flue gas is less than 10 ppm by volume.

15. A process as defined in claim 11 wherein no more than 5.0 SCF of total gaseous sulfur compounds per ton of said raw shale feed is discharged from said combustion zone in step (4).

16. A process as defined in claim 11 wherein the temperature in said combustion zone is maintained between about 1400° and 1650° F.

17. A process as defined in claim 16 wherein said oil shale is passed upwardly through said retorting zone and said retorted shale is passed downwardly through said combustor means.

18. A process as defined in claim 17 wherein said retorted shale, prior to being introduced into said combustion zone, is contacted with steam so as to obtain a product gas, said steam also being used to separate the gases utilized or produced in said retorting zone from those utilized or produced in said combustion zone.

19. A process as defined in claim 17 wherein said flue gas from step (4) and said heated cooling gas from step (5) are utilized to preheat said hot eduction gas to temperatures suitable for educing said gaseous mixture from said oil shale and are also utilized to obtain steam for water.

20. A process as defined in claim 19 wherein said hot, retorted shale contains a weight ratio of dolomite-plus-calcite to total sulfur of at least about 5:1.

21. A process as defined in claim 20 wherein the concentration of total gaseous sulfur compounds in said flue gas is less than 50 ppm by volume.

22. A process as defined in claim 20 wherein the concentration of total gaseous sulfur compounds in said flue gas is lss than 10 ppm by volume.

23. A process as defined in claim 22 wherein said retorted shale, prior to being introduced into said combustion zone, is contacted with steam so as to obtain a product gas, said steam also being used to separate the gases utilized or produced in said retorting zone from those utilized or produced in said combustion zone.

* * * * *

UNITED STATES PATENT OFFICE

CERTIFICATE OF CORRECTION

Patent No. 4,069,132 Dated January 17, 1978

Inventor(s) Roland F. Deering

It is certified that error appears in the above-identified patent and that said Letters Patent are hereby corrected as shown below:

Column 12, line 51, (claim 7) "about" should read --said--.

Column 14, line 20, (claim 19) "for" should read --from--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*